US005542187A

United States Patent [19]

Oakley

[11] Patent Number: 5,542,187

[45] Date of Patent: Aug. 6, 1996

[54] ALIGNMENT ASSEMBLY AND METHOD

[76] Inventor: William H. Oakley, P.O. Box 335, Sharon, S.C. 29742

[21] Appl. No.: 407,137

[22] Filed: Mar. 20, 1995

[51] Int. Cl.[6] ..... G01C 15/10; E04G 21/18

[52] U.S. Cl. ..... 33/404; 33/406; 33/518

[58] Field of Search ..... 33/404, 405, 406, 33/518

[56] References Cited

U.S. PATENT DOCUMENTS

| | | | |
|---|---|---|---|
| Re. 24,044 | 7/1955 | Breuninger . | |
| 140,943 | 7/1873 | Moseley . | |
| 2,612,695 | 10/1952 | Schneider et al. | 33/406 |
| 2,641,846 | 6/1953 | Zeno . | |
| 2,656,608 | 10/1953 | Craig et al. . | |
| 2,672,691 | 3/1954 | Sears et al. . | |
| 2,758,379 | 8/1956 | Senk . | |
| 2,788,579 | 4/1957 | Mills . | |
| 3,096,588 | 7/1963 | Cook . | |
| 3,422,539 | 1/1969 | Schneider . | |
| 3,768,167 | 10/1973 | Viau . | |
| 4,338,728 | 7/1982 | Valead | 33/406 |

FOREIGN PATENT DOCUMENTS

| | | | |
|---|---|---|---|
| 151537 | 5/1953 | Australia | 33/404 |
| 700207 | 11/1953 | United Kingdom | 33/404 |

*Primary Examiner*—Christopher W. Fulton
*Attorney, Agent, or Firm*—W. Thad Adams, III, P.A.

[57] ABSTRACT

An alignment assembly and method is provided. The alignment assembly is located adjacent to one end of a structure to be erected, and cooperates with a like assembly located adjacent to an opposite end of the structure for vertically aligning a surface of the structure as it is being erected. The alignment assembly includes a base having first and second spaced-apart legs for being driven into a supporting surface, and a web for interconnecting the first and second legs and maintaining the legs in spaced-apart relation. An upright is removably attached to the web, and extends vertically upwardly between the first and second legs of the base. A guide line is secured to the upright, and extends laterally from the first alignment assembly to the second alignment assembly. The guide line is moveable vertically along the upright to maintain the surface of the structure in vertical alignment as the structure is being erected.

9 Claims, 5 Drawing Sheets

ALIGNMENT ASSEMBLY AND METHOD

TECHNICAL FIELD AND BACKGROUND OF THE INVENTION

This invention relates to an alignment assembly and method. The invention is especially useful by brick masons and others in the construction industry when erecting vertically extending structures, such as foundation walls, chimney bases brick walls, brick steps, support piers, and the like. The alignment assembly is mounted near one end of the structure, and cooperates with a second, identical assembly mounted at an opposite end of the structure to maintain a true vertical surface as the structure is being erected.

According to one alignment technique of the prior art, several vertical corner poles are mounted at the corners and along the perimeter of a structure, such as a brick house, generally perpendicular to the supporting foundation. Guide lines extend between the corner poles to ensure that proper vertical leveling is achieved as the bricks are laid to form the corner edges and side walls of the house. The corner pole is held in a plumb condition by two or more anchoring legs. The legs are removably attached to the corner pole by complementary nuts and bolts, and generally have spiked ends for being driven into the ground surface. Precise mounting of the legs is critical to ensure proper alignment and location of the corner pole. Moreover, the separate anchoring legs and nuts and bolts must be securely stored together with the corner pole for proper assembly and mounting of the device.

According to another alignment technique, 2×4 wood segments are driven into the ground surface near the corners of the structure to be erected. The wood segments are vertically aligned using a standard leveling tool and a hammer. Generally, no separate anchoring members are used for holding the wood segment plumb. Thus, the segments must be accurately placed, and driven into the ground surface a sufficient distance to prevent slight movements and shifting during use. This technique generally provides an inferior measurement, and is time consuming and labor intensive.

The present invention overcomes many problems of prior art alignment devices by providing an assembly which includes a base for being mounted near one end of the structure to be aligned and an upright, such as a 2×4 wood segment. The upright is secured to the base using conventional C-clamps, and is laterally adjustable relative to the base after the base has been mounted. Thus, precise placement of the base is not required for achieving an accurate alignment. The base includes spaced-apart legs which prevent slight lateral movement or shifting of the upright which may cause inaccurate results. Moreover, the invention makes unnecessary the use of separate anchoring components which can be easily lost or misplaced.

SUMMARY OF THE INVENTION

Therefore, it is an object of the invention to provide an alignment assembly which provides accurate results, and includes relatively few component parts.

It is another object of the invention to provide an alignment assembly which is easily and quickly assembled and mounted for use.

It is another object of the invention to provide an alignment assembly including a base that can be securely mounted near a structure to be aligned without first obtaining an exact mounting location.

It is another object of the invention to provide an alignment assembly including an upright which can be vertically aligned and laterally shifted along a section of the base after the base has been securely mounted to the ground surface.

It is another object of the invention to provide a alignment assembly including a base which is easily driven into the ground surface.

It is another object of the invention to provide an alignment assembly which is durable, and relatively inexpensive to manufacture.

It is another object of the invention to provide a method of vertically aligning a structure to be erected.

These and other objects of the present invention are achieved in the preferred embodiments disclosed below by providing an alignment assembly and method. The alignment assembly is located adjacent to one end of a structure to be erected, and cooperates with a like assembly located adjacent to an opposite end of the structure for vertically aligning a surface of the structure as it is being erected. The alignment assembly includes a base having first and second spaced-apart legs for being driven into a supporting surface, and web means for interconnecting the first and second legs and maintaining the legs in spaced-apart relation. An upright is removably attached to the web means, and extends vertically upwardly between the first and second legs of the base. A guide line is secured to the upright, and extends laterally from the first alignment assembly to the second alignment assembly. The guide line is moveable vertically along the upright to maintain the surface of the structure in vertical alignment as the structure is being erected.

According to one preferred embodiment of the invention, the web means of the base includes first and second, vertically spaced flat iron webs.

According to another preferred embodiment of the invention, the first and second legs of the base include respective steel rods.

According to yet another preferred embodiment of the invention, the steel rods have respective spiked end portions for being driven into the supporting surface.

According to yet another preferred embodiment of the invention, an attachment clamp serves to removably attach the upright to the web means of the base.

According to yet another preferred embodiment of the invention, a line carrier serves to releasably hold the guide line adjacent to the upright.

According to yet another preferred embodiment of the invention, the upright includes a plurality of markings vertically spaced apart in unit intervals.

According to yet another preferred embodiment of the invention, the upright is an elongate wood segment.

An embodiment of the method according to the invention comprises the steps of locating first and second alignment assemblies adjacent to opposite ends of a structure to be erected. Each alignment assembly has a base including first and second spaced apart legs, and web means for interconnecting the first and second legs and maintaining the legs in spaced-apart relation to each other. An upright is then attached to the base of each alignment assembly, and a guide line extended from the upright of the first alignment assembly to the upright of the second alignment assembly. The guide line is moved vertically along the uprights to maintain the surface of the structure in vertical alignment as the structure is being erected. BRIEF DESCRIPTION OF THE DRAWINGS Some of the objects of the invention have been set forth above. Other objects and advantages of the invention will appear as the invention proceeds when taken in conjunction with the following drawings, in which:

DESCRIPTION OF THE PREFERRED EMBODIMENT AND BEST MODE

Figure 1:
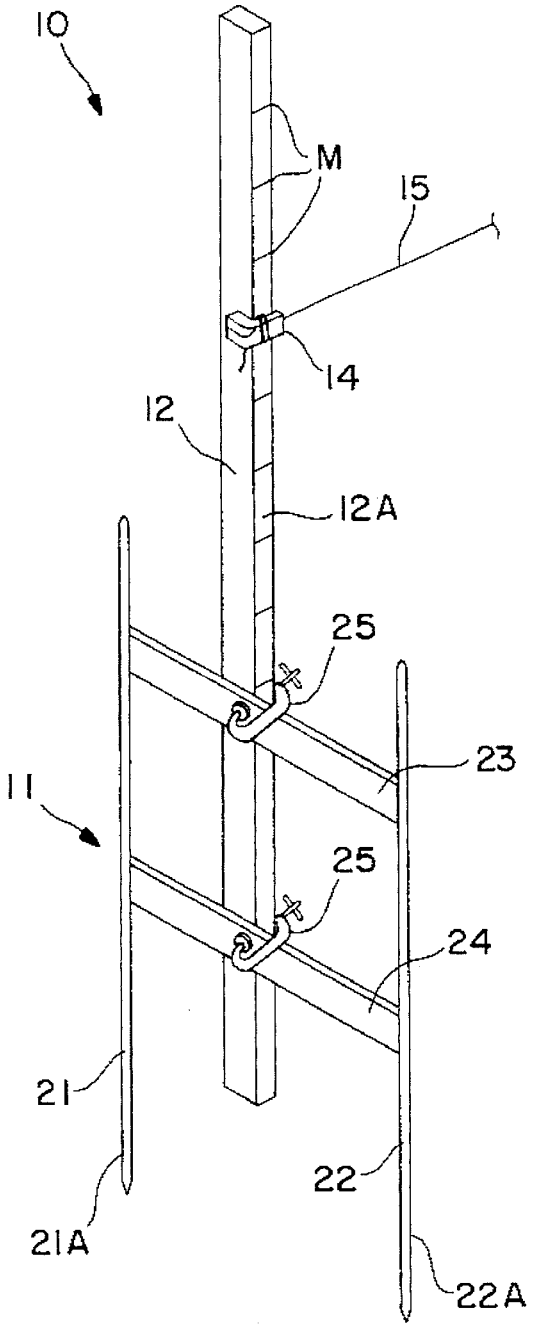
FIG. 1 is a perspective view of the alignment assembly according to one preferred embodiment of the invention.

Referring now specifically to the drawings, an alignment assembly according to the present invention is illustrated in FIG. 1 and shown generally at reference numeral 10. The alignment assembly 10 is especially useful by brick masons and others in the construction industry when erecting vertically extending structures, such as foundation walls, chimney bases, brick walls, brick steps, support piers, and the like. The alignment assembly 10 is mounted near one end of the structure, and cooperates with a second, identical assembly mounted at an opposite end of the structure to maintain a true vertical surface as the structure is being erected.

Figure 2:
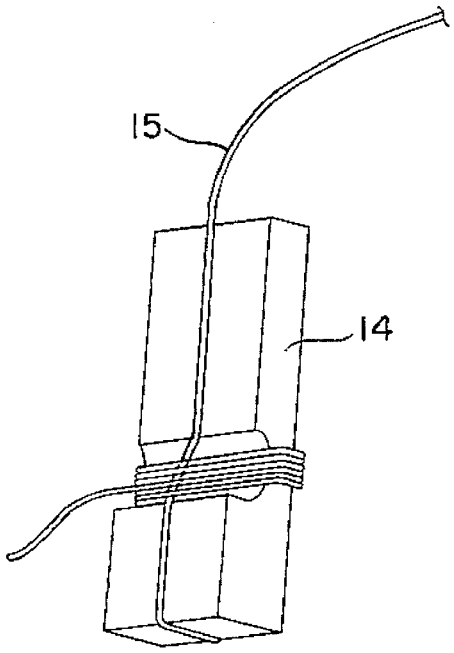
FIG. 2 is a perspective view of the line carrier for releasably holding an end of the guide line adjacent to the upright.

Referring to FIGS. 1 and 2, the alignment assembly 10 includes a base 11, an upright 12 attached to the base 11, a line carrier 14, and a guide line 15. The base 11 includes first and second legs 21 and 22, and a pair vertically spaced flat webs 23 and 24 interconnecting the legs 21, 22, and maintaining the legs 21, 22 in space-apart relation to each other. Each leg 21 and 22 preferably has a spiked end portion 21A and 22A for allowing the base 11 to be easily driven into the ground surface using a conventional tool, such as a hammer. According to one embodiment, the legs 21 and 22 are formed of three-quarter inch diameter steel rods. The webs 23 and 24 are preferably formed of one-quarter inch thick flat iron sections welded to each of the legs 21 and 22.

Once the base 11 is securely mounted to the ground near the structure, the upright 12 is removably attached to the flat webs 23 and 24 of the base 11 by C-clamps 25, or other suitable means. Before fully tightening the clamps 25, a standard leveling tool may be applied to a side 12A of upright 12 to vertically align the upright 12. Because the upright 12 can be pivoted relative to the base 11 and readily moved laterally along the length of the webs 23 and 24 after the base 11 has been mounted, exact placement and leveling of the base 11 is not required. The spaced apart legs 21 and 22 of the base 11 serve to maintain the upright 12 in a vertically aligned condition during use. Preferably, the upright 12 is a 2×4 wood segment marked off in unit intervals "M" such as inches or centimeters.

The guide line 15 extends laterally between the pair of spaced apart alignment assemblies 10, and is tied at its opposite ends to respective line carriers 14. Each line carrier 14 is preferably constructed of wood, and is held adjacent to the upright 12 by tension in the guide line 15 and the effect of friction between the contacting surfaces of the line carrier 14 and upright 12. As construction of the structure progresses, the line carriers 14 are slid upwardly along the uprights 12 to maintain the surface of the structure in vertical alignment with the uprights 12.

Figure 3:
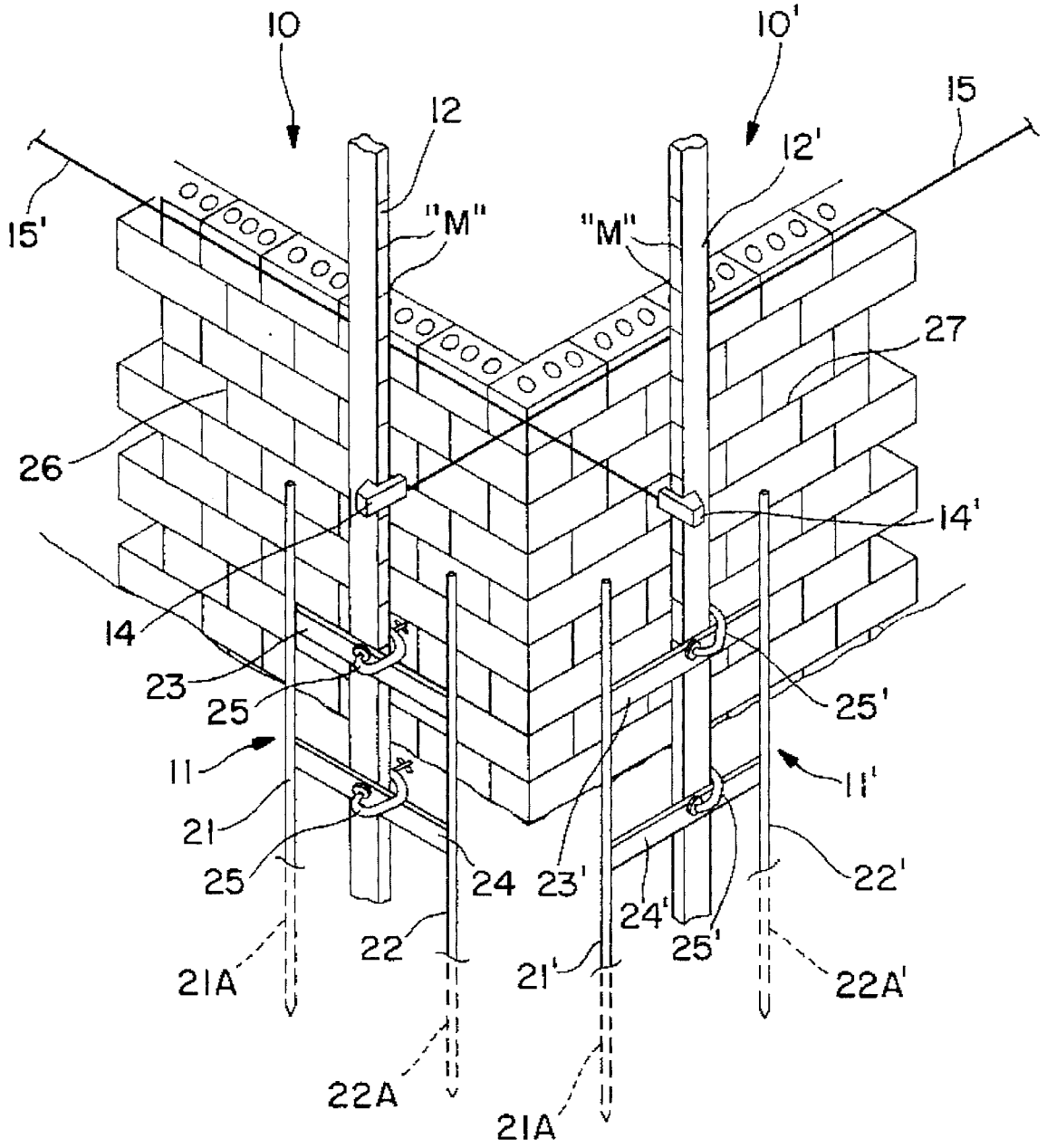
FIG. 3 is a fragmentary perspective view showing the alignment assemblies used for vertically aligning the outside surfaces of two intersecting brick walls.
Figure 4:
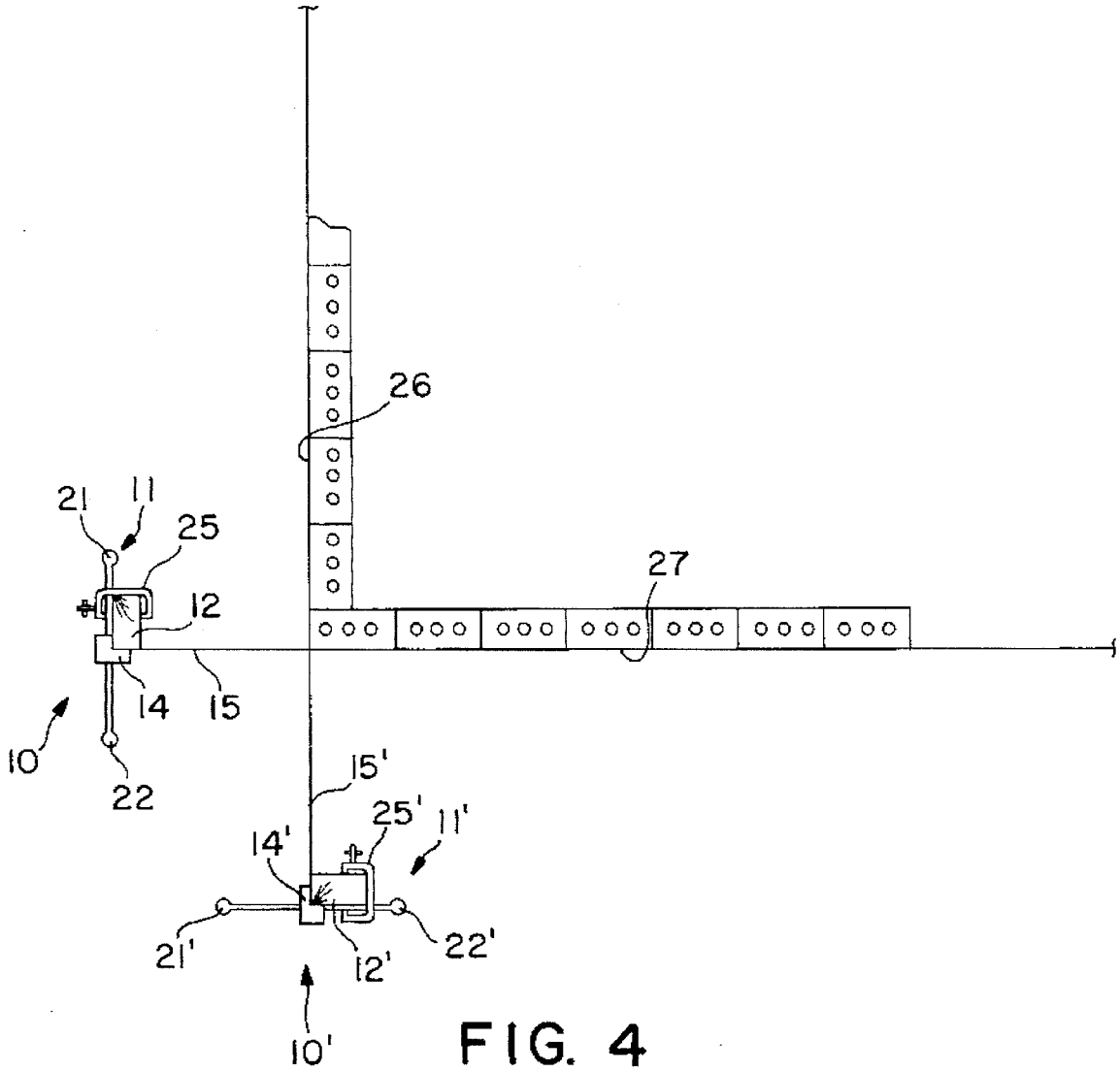
FIG. 4 is a fragmentary top plan view showing the alignment assemblies and brick walls illustrated in FIG. 3.

FIGS. 3 and 4 illustrate alignment assemblies 10 and 10' used for vertically aligning respective outer surfaces of two intersecting brick walls 26 and 27. Although not shown, identical alignment assemblies are located near opposite ends of the brick walls 26 and 27. Thus, a first pair of alignment assemblies 10 is used to vertically align the wall 26, while an identical second pair of alignment assemblies 10' may be simultaneously used to vertically align the wall 27. Like elements are indicated in prime notation.

Figure 5:
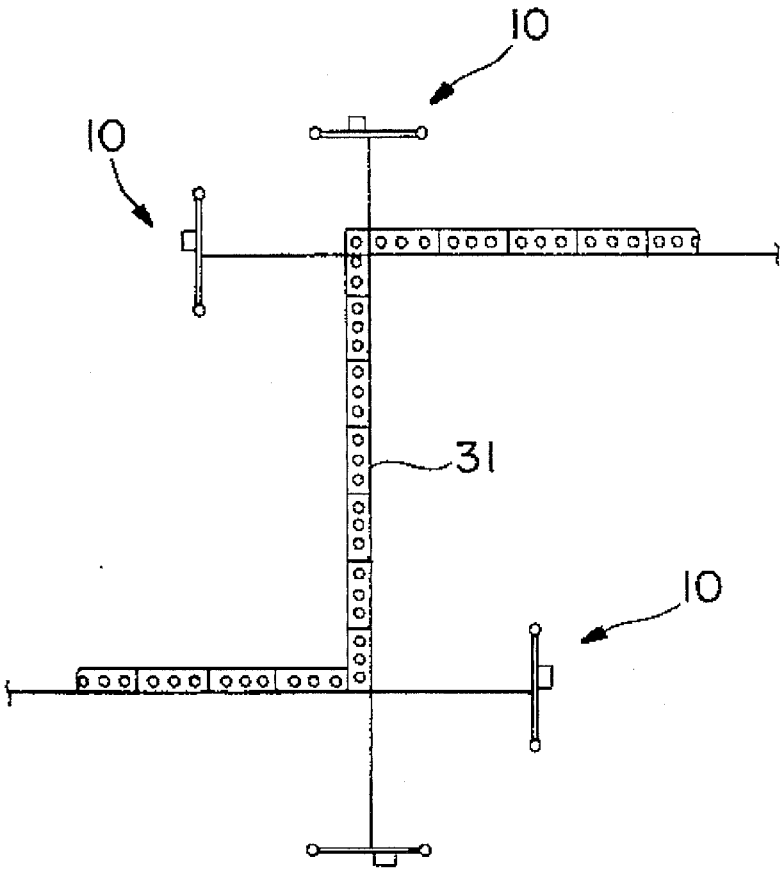
FIG. 5 is a fragmentary top plan view showing the alignment assemblies used for vertically aligning the surfaces of an angled brick foundation wall.
Figure 6:
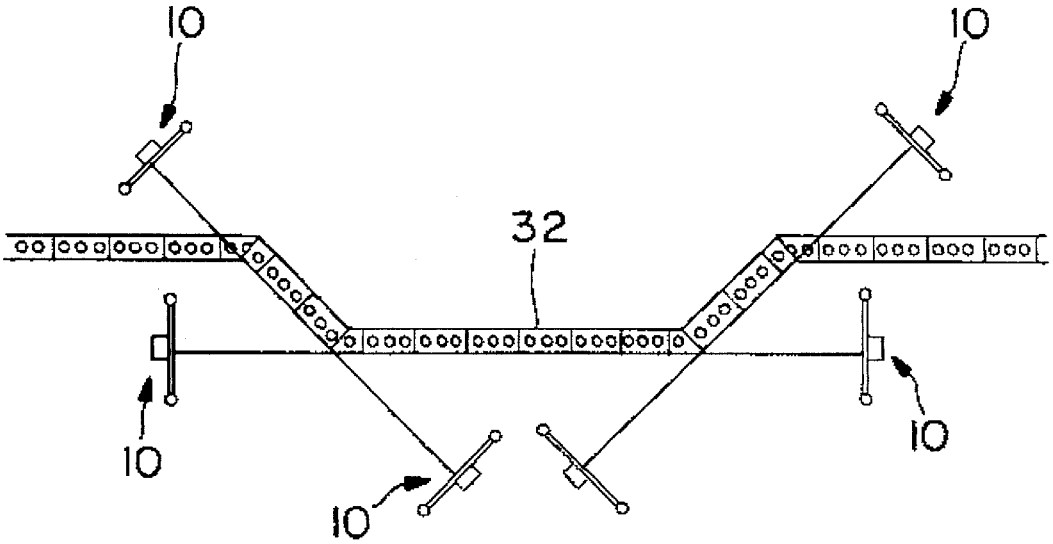
FIG. 6 is a fragmentary top plan view showing the alignment assemblies used for vertically aligning the brick sides of a bay window.
Figure 7:
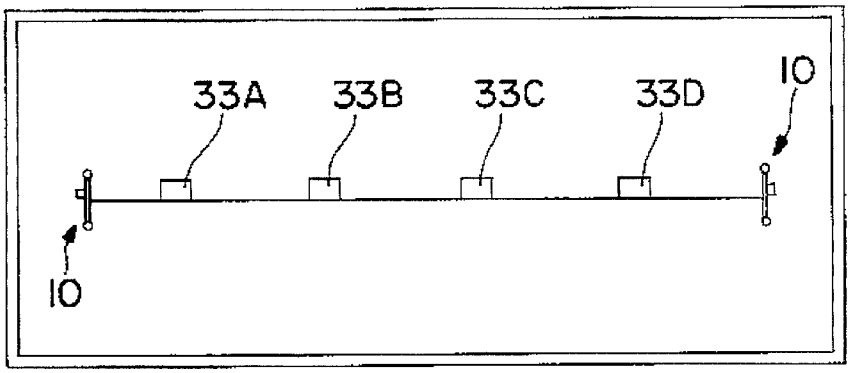
FIG. 7 is a top plan view showing the alignment assemblies used for vertically aligning a plurality of interior support piers.
Figure 8:
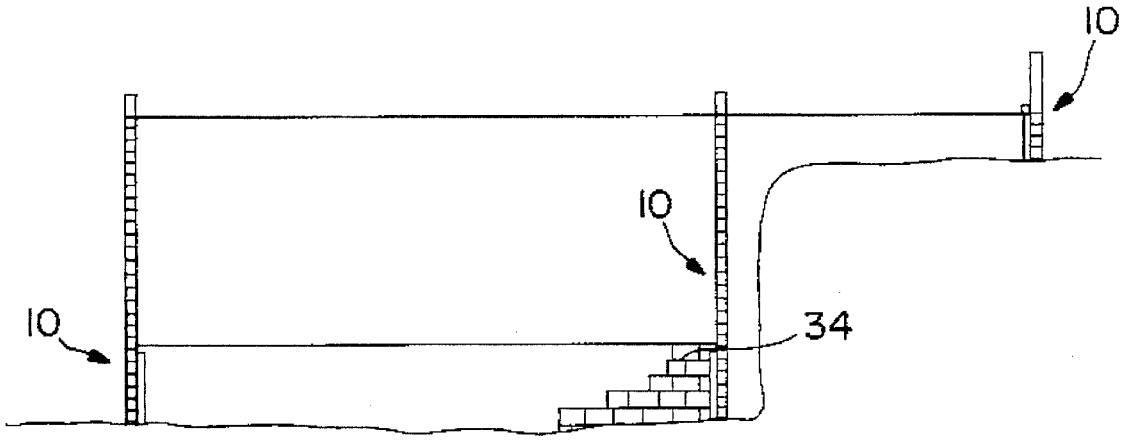
FIG. 8 is a side elevation showing the alignment assemblies used for vertically aligning the walls of a basement.

FIGS. 5–8 illustrate other applications of the alignment assembly 10. As shown in FIG. 5, several alignment assemblies 10 may be used for vertically aligning the surfaces of an angled brick foundation 31. FIG. 6 illustrates the use of several alignment assemblies 10 for vertically aligning the sides of a bay window 32. FIG. 7 illustrates the use of alignment assemblies 10 for vertically aligning a plurality of interior support piers 33A, 33B, 33C, and 33D. As shown in FIG. 8, the alignment assembly 10 may also be used for vertically aligning the walls of a basement 34.

In addition to the above, the alignment assembly 10 may be used for horizontal leveling. For example, when erecting a brick wall, a pair of alignment assemblies are mounted near opposite ends of the wall. The guide line extends in a horizontally level condition from the upright of the first assembly to the upright of the second assembly to ensure that adjacent bricks remain horizontally aligned as the wall is constructed. The markings of the uprights allow for proper vertical movement of the carriers as the height of the wall increases.

An alignment assembly and method are described above. Various details of the invention may be changed without departing from its scope. Furthermore, the foregoing description of the preferred embodiment of the invention is provided for the purpose of illustration only and not for the purpose of limitation-the invention being defined by the claims.

I claim:

1. An alignment assembly for being located adjacent to one end of a structure to be erected, and cooperating with a like assembly located adjacent to an opposite end of the structure for vertically aligning a surface of the structure as it is being erected, said alignment assembly comprising:

(a) a base consisting of first and second laterally spaced-apart legs including respective integrally-formed spiked end portions for being driven downwardly into a supporting surface a sufficient depth to mount the base in a stable condition during use in the absence of separate anchoring components, and web means vertically spaced apart from the supporting surface for interconnecting the first and second legs and maintaining the legs in spaced-apart relation to each other;

(b) an upright for being removably attached to said web means, and extending vertically upwardly between the first and second legs of said base; and (c) a guide line for being secured to said upright, and extending laterally from the first alignment assembly to the second alignment assembly, said guide line being moveable vertically along said upright to maintain the surface of the structure in vertical alignment as the structure is being erected.

2. An alignment assembly according to claim 1, wherein the web means of said base comprises first and second, vertically spaced flat iron webs.

3. An alignment assembly according to claim 1, wherein the first and second legs of said base comprise respective steel rods.

4. An alignment assembly according to claim 3, wherein said steel rods have respective spiked end portions for being driven into the supporting surface.

5. An alignment assembly according to claim 1, and including an attachment clamp for removably attaching said upright to the web means of said base.

6. An alignment assembly according to claim 1, and including a line carrier for releasably holding the guide line adjacent to said upright.

7. An alignment assembly according to claim 1, wherein said upright includes a plurality of markings vertically spaced apart in unit intervals.

8. An alignment assembly according to claim 1, wherein said upright comprises an elongate wood segment.

9. A method of vertically aligning a surface of a structure to be erected, comprising the steps of:

(a) locating first and second alignment assemblies adjacent to opposite ends of the structure, each alignment assembly having a base consisting of first and second laterally spaced apart legs having respective integrally-formed spiked end portions for being driven downwardly into a supporting surface a sufficient depth to mount the base in a stable condition during use in the absence of separate anchoring components, and web means vertically spaced apart from the supporting surface interconnecting the first and second legs and maintaining the legs in spaced-apart relation to each other;

(b) attaching an upright to the base of each alignment assembly;

(c) extending a guide line from the upright of the first alignment assembly to the upright of the second alignment assembly; and (d) moving the guide line vertically along said uprights to maintain the surface of the structure in vertical alignment as the structure is being erected.

* * * * *